US011608552B2

(12) United States Patent
Scott et al.

(10) Patent No.: US 11,608,552 B2
(45) **Date of Patent: *Mar. 21, 2023**

(54) CHROMIUM-FREE THERMAL SPRAY COMPOSITION, METHOD, AND APPARATUS

(71) Applicant: INNOVEX DOWNHOLE SOLUTIONS, INC., Houston, TX (US)

(72) Inventors: Joe Lynn Scott, Tomball, TX (US); John H. Gammage, Cleveland, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/781,029

(22) Filed: Feb. 4, 2020

(65) Prior Publication Data

US 2020/0173006 A1 Jun. 4, 2020

Related U.S. Application Data

(60) Continuation of application No. 15/892,451, filed on Feb. 9, 2018, now Pat. No. 10,577,685, which is a (Continued)

(51) Int. Cl.
*C23C 4/08* (2016.01)
*C22C 38/42* (2006.01)

(Continued)

(52) U.S. Cl.
CPC ..... *C23C 4/08* (2013.01); *C22C 38/002* (2013.01); *C22C 38/02* (2013.01); *C22C 38/06* (2013.01);

(Continued)

(58) Field of Classification Search
CPC .. C23C 4/08; C23C 4/12; C23C 4/131; C23C 5/14; E21B 17/1078

(Continued)

(56) References Cited

U.S. PATENT DOCUMENTS 1,201,706 A 10/1916 Dodge
2,368,401 A 1/1945 Baker (Continued)

FOREIGN PATENT DOCUMENTS

EP 0088507 A1 9/1983
EP 0701041 A2 3/1996

(Continued)

OTHER PUBLICATIONS

NPL-1: Scott et al, Wear resistant coating for downhole tubulars and tools, Corrosion 2010, San Antonio, Texas, Mar. 2010, (Year: 2010).*

(Continued)

*Primary Examiner* — Jie Yang
(74) *Attorney, Agent, or Firm* — MH2 Technology Law Group LLP

(57) ABSTRACT

A method for applying a composition to a substrate, and a downhole component, of which the method includes thermal spraying a layer of the composition onto the substrate, the substrate being provided by a downhole component, the layer resulting from the thermal spraying having a thickness of at least about 0.10 inches and being configured to remain bonded to the downhole component when used downhole in a well, the composition being chromium-free.

21 Claims, 6 Drawing Sheets

Related U.S. Application Data division of application No. 14/471,630, filed on Aug. 28, 2014, now Pat. No. 9,920,412.

(60) Provisional application No. 61/871,143, filed on Aug. 28, 2013.

(51) Int. Cl.

| | |
|---|---|
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C22C 38/06*** | (2006.01) |
| ***C22C 38/02*** | (2006.01) |
| ***C22C 38/00*** | (2006.01) |
| ***E21B 17/10*** | (2006.01) |
| ***C23C 4/131*** | (2016.01) |
| *C23C 4/14* | (2016.01) |
| *C23C 4/12* | (2016.01) |

(52) U.S. Cl.

CPC ..... *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C23C 4/131* (2016.01); *E21B 17/1078* (2013.01); *C23C 4/12* (2013.01); *C23C 4/14* (2013.01)

(58) Field of Classification Search

USPC ..... 148/330

See application file for complete search history.

(56) References Cited

U.S. PATENT DOCUMENTS

| | | | |
|---|---|---|---|
| 2,496,402 | A | 2/1950 | McVeigh et al. |
| 2,797,756 | A | 7/1957 | Hall, Sr. |
| 2,824,613 | A | 2/1958 | Baker et al. |
| 2,841,226 | A | 7/1958 | Conrad et al. |
| 2,855,052 | A | 10/1958 | Wright et al. |
| 2,962,313 | A | 11/1960 | Conrad |
| 2,986,417 | A | 5/1961 | Baker |
| 3,012,881 | A | 12/1961 | Cape |
| 3,040,405 | A | 6/1962 | Solum |
| 3,063,760 | A | 11/1962 | Gifford |
| 3,124,196 | A | 3/1964 | Solum |
| 3,292,708 | A | 12/1966 | Mundt |
| 3,360,846 | A | 1/1968 | Schellstede et al. |
| 3,563,575 | A | 2/1971 | Sanford |
| 3,566,965 | A | 3/1971 | Solum |
| 3,643,739 | A | 2/1972 | Hall, Sr. |
| 3,652,138 | A | 3/1972 | Collett |
| 3,916,998 | A | 11/1975 | Bass, Jr. et al. |
| 4,101,713 | A | 7/1978 | Hirsch et al. |
| 4,146,060 | A | 3/1979 | Garrett |
| 4,363,360 | A | 12/1982 | Richey |
| 4,367,053 | A | 1/1983 | Stratienko et al. |
| 4,434,125 | A | 2/1984 | Lavender et al. |
| 4,473,401 | A | 9/1984 | Masumoto et al. |
| 4,531,582 | A | 7/1985 | Muse et al. |
| 4,630,692 | A | 12/1986 | Ecer |
| 4,634,314 | A | 1/1987 | Pierce |
| 4,665,996 | A | 5/1987 | Foroulis et al. |
| 4,822,415 | A | 4/1989 | Dorfman et al. |
| 5,004,153 | A | 4/1991 | Sawyer |
| H1192 | H | 6/1993 | Keller |
| 5,340,615 | A | 8/1994 | Browning |
| 5,384,164 | A | 1/1995 | Browning |
| 5,501,281 | A | 3/1996 | White et al. |
| 5,517,878 | A | 5/1996 | Klein et al. |
| 5,652,028 | A | 7/1997 | Taylor et al. |
| 5,679,335 | A | 10/1997 | Legrow et al. |
| 5,697,442 | A | 12/1997 | Baldridge |
| 5,706,894 | A | 1/1998 | Hawkins, III |
| 5,743,302 | A | 4/1998 | McNeely |
| 5,817,958 | A | 10/1998 | Swisher et al. |
| 5,860,760 | A | 1/1999 | Kirk |
| 5,908,072 | A | 6/1999 | Hawkins |
| 5,932,293 | A | 8/1999 | Belashchenko et al. |
| 5,979,508 | A | 11/1999 | Cherrington |
| 6,083,330 | A | 7/2000 | Moskowitz |
| 6,199,633 | B1 | 3/2001 | Longbottom |
| 6,361,243 | B1 | 3/2002 | Geib |
| 6,372,298 | B1 * | 4/2002 | Marantz ..... B05B 7/224 219/121.5 |
| 6,484,803 | B1 | 11/2002 | Gremillion |
| 6,503,576 | B1 | 1/2003 | Russo et al. |
| 6,557,654 | B1 | 5/2003 | Murray |
| 6,571,472 | B2 | 6/2003 | Berry et al. |
| 6,575,350 | B2 | 6/2003 | Evans et al. |
| 6,578,539 | B2 | 6/2003 | Barbezat |
| 6,634,781 | B2 | 10/2003 | Bowens et al. |
| 6,649,682 | B1 | 11/2003 | Breton et al. |
| 6,679,325 | B2 | 1/2004 | Buytaert |
| 6,957,704 | B2 | 10/2005 | Rogers et al. |
| 7,105,205 | B2 | 9/2006 | Clayton et al. |
| 7,139,219 | B2 | 11/2006 | Kolle et al. |
| 7,159,619 | B2 | 1/2007 | Latiolais, Jr. et al. |
| 7,216,814 | B2 | 5/2007 | Gardega |
| 7,487,840 | B2 | 2/2009 | Gammage et al. |
| 8,832,906 | B2 | 9/2014 | Buytaert et al. |
| 9,920,412 | B2 * | 3/2018 | Scott ..... C22C 38/44 |
| 10,577,685 | B2 * | 3/2020 | Scott ..... C23C 4/08 |
| 2001/0030067 | A1 | 10/2001 | Evans et al. |
| 2002/0139537 | A1 | 10/2002 | Young |
| 2003/0019637 | A1 | 1/2003 | Slack et al. |
| 2003/0150611 | A1 | 8/2003 | Buytaert |
| 2003/0219544 | A1 | 11/2003 | Smith et al. |
| 2004/0140021 | A1 | 7/2004 | Branagan |
| 2004/0206726 | A1 | 10/2004 | Daemen et al. |
| 2004/0265503 | A1 | 12/2004 | Clayton et al. |
| 2005/0178558 | A1 | 8/2005 | Kolle et al. |
| 2005/0199739 | A1 | 9/2005 | Kuroda et al. |
| 2005/0241147 | A1 | 11/2005 | Arnold et al. |
| 2006/0062928 | A1 | 3/2006 | Lichtblau |
| 2006/0102354 | A1 * | 5/2006 | Gammage ..... B32B 15/011 166/304 |
| 2006/0185908 | A1 | 8/2006 | Kembaiyan et al. |
| 2007/0243335 | A1 | 10/2007 | Belashchenko |
| 2007/0284037 | A1 | 12/2007 | Buytaert |
| 2008/0087359 | A1 * | 4/2008 | Zurecki ..... C23C 4/02 148/511 |
| 2008/0156488 | A1 | 7/2008 | Thornton |
| 2008/0217063 | A1 | 9/2008 | Moore et al. |
| 2009/0255666 | A1 | 10/2009 | Olsen et al. |
| 2009/0258250 | A1 | 10/2009 | Daemen et al. |
| 2010/0059218 | A1 | 3/2010 | Whitelaw |
| 2011/0114338 | A1 | 5/2011 | Casassa et al. |
| 2012/0097658 | A1 | 4/2012 | Wallin et al. |
| 2012/0186808 | A1 | 7/2012 | Lively et al. |
| 2012/0292043 | A1 * | 11/2012 | Thornton ..... E21B 17/1078 166/369 |
| 2013/0025881 | A1 | 1/2013 | Buytaert et al. |
| 2014/0367085 | A1 | 12/2014 | Levie et al. |
| 2015/0360285 | A1 | 12/2015 | Dorner et al. |
| 2019/0010598 | A1 | 1/2019 | Scott et al. |
| 2019/0309405 | A1 | 10/2019 | Scott et al. |
| 2019/0309406 | A1 | 10/2019 | Scott et al. |
| 2020/0056276 | A1 * | 2/2020 | Scott ..... C23C 4/06 |

FOREIGN PATENT DOCUMENTS

| | | | |
|---|---|---|---|
| EP | 3039168 | B1 | 10/2018 |
| GB | 2304753 | A | 3/1997 |
| GB | 2358418 | A | 7/2001 |
| GB | 2406591 | A | 4/2005 |
| GB | 2431664 | A | 5/2007 |

(56) References Cited

FOREIGN PATENT DOCUMENTS

| | | | |
|---|---|---|---|
| JP | 2000-052086 | A | 2/2000 |
| JP | 2004-068142 | A | 3/2004 |
| JP | 2010-242173 | A | 10/2010 |
| KR | 950014072 | B1 | 11/1995 |
| WO | 2002004781 | A1 | 1/2002 |
| WO | 2004015238 | A1 | 2/2004 |
| WO | 2007143324 | A1 | 12/2007 |

OTHER PUBLICATIONS

Pro-Fusion Technologies, Inc., The Plasma Arc Welding Process, [online], retrieved from the internet on Aug. 27, 2014, pp. 1-3, http://www.pro-fusononline.com/welding/plasma.htm.
Gordon England, Arc Wire Thermal Spray Process (ArcSpray), [online], retrieved from the internet on Aug. 27, 2014, pp. 1-3, http://www.gordonengland.co.uk/aws.htm.
Jong-Hwan Kim et al., High Velocity Oxyfuel Deposition for Low Surface Roughness PS304 Self-Lubricating Composite Coatings, Tribology Transactions, 47, 2004, pp. 157-169, retrieved from the internet on Aug. 27, 2014, http://www.tandfonline.com/doi/pdf/10.1080/05698190490278958.
International Search Report and Written Opinion dated Dec. 11, 2014, International Application No. PCT/US2014/053206, filed Aug. 28, 2014, pp. 1-10.
Final Office Action dated Apr. 9, 2014, U.S. Appl. No. 13/191,074, filed Jul. 26, 2011, pp. 1-20.
PCT International Search Report dated Jul. 16, 2014, PCT Application No. PCT/EP2013/057416, filed Apr. 9, 2013, pp. 1-6.
Combined Search and Examination Report dated Feb. 5, 2014, GB Application No. 1215868.9, pp. 1-2.
David. E. Y. Levie et al., Modified Tubular, U.S. Appl. No. 14/374,442, filed Jul. 24, 2014.
Non-Final Office Action dated Aug. 21, 2015, U.S. Appl. No. 14/374,442, filed Jul. 24, 2014, pp. 1-9.
Final Office Action dated Dec. 9, 2015, U.S. Appl. No. 14/374,442, filed Jul. 24, 2014, pp. 1-9.
Non-Final Office Action dated Sep. 13, 2012, U.S. Appl. No. 12/756,177, filed Apr. 8, 2010, pp. 1-24.
Final Office Action dated Feb. 1, 2013, U.S. Appl. No. 12/756,177, filed Apr. 8, 2010, pp. 1-45.
Non-Final Office Action dated Aug. 14, 2013, U.S. Appl. No. 12/756,177, filed Apr. 8, 2010, pp. 1-40.
Final Office Action dated Mar. 13, 2014, U.S. Appl. No. 12/756,177, filed Apr. 8, 2010, pp. 1-21.
PCT International Search Report dated Dec. 23, 2010, PCT Application No. PCT/US2010/037441, filed Jun. 4, 2010, pp. 1-5.
Non-Final Office Action dated Oct. 24, 2013, U.S. Appl. No. 13/191,074, filed Jul. 26, 2011, pp. 1-20.
Final Office Action dated Jan. 5, 2017, U.S. Appl. No. 14/502,799, filed Sep. 30, 2014, pp. 1-10.
Extended European Search Report dated Mar. 17, 2017, European Application No. 14839839, filed Aug. 28, 2014, pp. 1-7.
Autorenkollektiv: "Spurenelemente im Stahl—Moeglichkeiten zur Beeinflussung im Smelzbetrieb", Spurenelemente in Staehlen, Verlag Stahleisen, Duesseldorf, DE, Jan. 1, 1985, XP002433212, pp. 19-22. (English translation not provided by EP Patent Office).
Extended European Search Report dated Oct. 8, 2018, EP Application No. EP18191926, filed Aug. 31, 2018, pp. 1-10.
Communication Pursuant to Article 94(3) EPC dated May 25, 2021, EP Application No. 18191926 7, 5 pages.

* cited by examiner

CHROMIUM-FREE THERMAL SPRAY COMPOSITION, METHOD, AND APPARATUS

CROSS-REFERENCE TO RELATED APPLICATIONS

This application is a continuation of U.S. patent application having Ser. No. 15/892,451, which was filed on Feb. 9, 2018, and which is a divisional of U.S. patent application having Ser. No. 14/471,630, now U.S. Pat. No. 9,920,412, which was filed on Aug. 28, 2014, and which claims priority to U.S. Provisional Patent Application having Ser. No. 61/871,143, which was filed on Aug. 28, 2013. The entirety of each of these disclosures is incorporated herein by reference.

BACKGROUND

Tools are attached to casing strings, drill strings, or other oilfield tubulars, to accomplish a variety of different tasks in a wellbore. Such tools may include centralizers, stabilizers, packers, cement baskets, hole openers, scrapers, control-line protectors, turbulators, and the like. Each tool may have a different purpose in a downhole environment, and each may have a different construction in order to accomplish that purpose. However, each is generally attached around the outer diameter of the oilfield tubular.

When deployed into the wellbore, the tools may abrade or spall by engagement with a surrounding tubular (e.g., a casing, liner, or the wellbore wall itself). Further, the tools may engage foreign bodies in the well, such as cuttings or other bodies, as are known in the art, which may also wear the tools. Accordingly, wear-resistance and a low coefficient of friction may be valuable characteristics for the downhole tools.

One way to enhance the material properties of the exterior of the tools is to weld another material thereto. This is referred to as "hardbanding." Hardbanding, however, generally includes the application of intense heat for the welding process, which may damage the underlying tool structure. Thermal spraying is thus sometimes used for the coating process. Thermal spraying may include melting and spraying a material onto the tool (or another substrate) to be coated. Thermal spraying, however, generally results in poor bonding and poor structural characteristics when built up to thick layers. Furthermore, thermal spraying often employs materials that include high levels of chromium, which presents health and safety issues and may require special handling procedures and equipment.

Furthermore, connecting the tools to the tubular may present challenges. The tools may be connected directly to the tubular, or a "stop collar" may be fixed to the tubular, e.g., between the pipe joints, which may be configured to engage the tool. One way to connect the tool or stop collar to the tubular is by welding it to the tubular. As with hardbanding, however, the strong hold of a weld may come at the expense of damaging the tubular and/or the tool, e.g., by creating a heat-affected zone (HAZ) in either or both. The HAZ may represent an area of the tubular where the metallurgical properties are altered, which may translate into diminished strength, corrosion resistance, or certain other characteristics. Accordingly, in some applications, an HAZ may be avoided.

Set screws and/or adhesive are thus sometimes used to attach a tool to a tubular, since these attachment methods do not create an HAZ. However, set screws and adhesives may not provide adequate holding force for the tubular, and/or may not be sufficiently corrosion or heat resistant.

SUMMARY

Embodiments of the disclosure may provide a method for applying a composition to a substrate, the method including thermal spraying a layer of the composition onto the substrate provided by a downhole component, the layer resulting from the thermal spraying having a thickness of at least about 0.10 inches and being configured to remain bonded to the downhole component when used downhole in a well, the composition being chromium-free.

Embodiments of the disclosure may also provide a downhole component including a substrate, and a layer of a composition bonded to the substrate. The layer is thermally sprayed onto the substrate so as to bond therewith, the composition has a thickness of at least about 0.10 inches, includes iron and is chromium-free.

Embodiments of the disclosure may also provide a tubular, and a downhole tool bonded to the tubular. The downhole tool includes a layer of a composition that is thermally sprayed onto the tubular. The composition includes iron and is free from chromium. The tubular is free from a heat-affected zone where the layer of the composition is sprayed onto the tubular. No adhesive is positioned between the tubular and the layer, and wherein the composition has a thickness of at least about 0.10 inches.

BRIEF DESCRIPTION OF THE DRAWINGS

Embodiments of the present disclosure may best be understood by referring to the following description and accompanying drawings that are used to illustrate several example embodiments. In the drawings.

DETAILED DESCRIPTION

Figure 1:
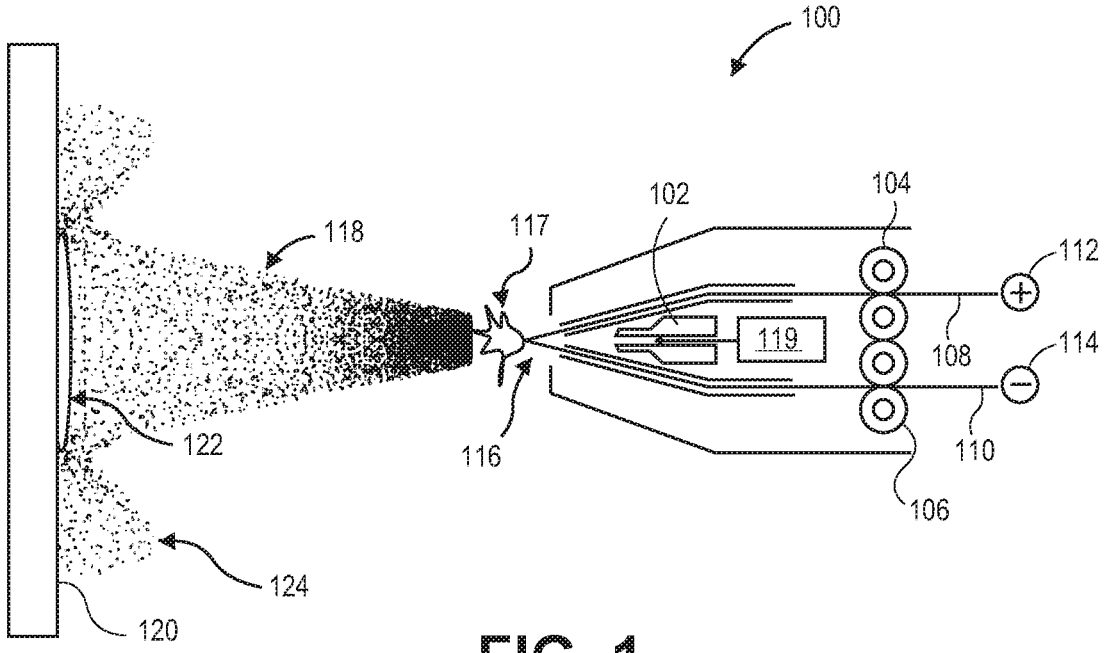
FIG. 1 illustrates a side schematic view of a sprayer apparatus, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

Embodiments of the present disclosure may provide a composition, which may be used in a thermal spraying operation, for example, in combination with a downhole component such as a downhole tool and/or an oilfield tubular. The downhole component may thus act as a substrate upon which the composition is deposited. One or more (e.g., many) layers of the composition may be deposited onto the substrate, such that the composition protrudes outwards therefrom.

The composition may be free from chromium. The composition being "free from chromium" means the composition includes at most trace amounts of chromium. In other words, chromium may be present in a composition that is "free from chromium" in amounts less than would be seen if intentionally included in the composition.

Furthermore, the composition may be deposited such that the depositing process does not raise the nominal temperature of the substrate to an extent that would alter the metallurgical properties of the substrate. For example, the depositing may not raise the nominal temperature of the substrate (e.g., the average temperature in a region proximal to, and heated by heat from, the deposited material from the thermal sprayer) to an extent that would alter the metallurgical properties of the substrate. In an embodiment, this may be accomplished at least in part by the composition being melted and sprayed in fine droplets, such that the thermal energy contained in the droplets, as the droplets collide with the substrate, is insufficient to raise the nominal temperature of the substrate to a degree sufficient to substantially alter the metallurgical properties of the substrate. In other embodiments, however, the material may be used as part of processes at higher temperatures, which may create a heat-affected zone.

In some embodiments, the composition may include about 0.25 wt % to about 1.25 wt % of carbon, about 1.0 wt % to about 3.5 wt % of manganese, about 0.1 wt % to about 1.4 wt % of silicon, about 1.0 wt % to about 3.0 wt % of nickel, about 0.0 to about 2.0 wt % of molybdenum, about 0.7 wt % to about 2.5 wt % of aluminum, about 1.0 wt % to about 2.7 wt % of vanadium, about 1.5 wt % to about 3.0 wt % of titanium, about 0.0 wt % to about 6.0 wt % of niobium, about 3.5 wt % to about 5.5 wt % of boron, about 0.0 wt % to about 10.0 wt % tungsten, and a balance of iron.

As the term is used herein "a balance of iron" (or equivalently, "the balance being iron") means that the balance of the percentage composition by weight, after considering the other listed elements, is iron, either entirely or entirely except for trace elements of one or more other materials.

Other specific embodiments of the composition are contemplated. For example, the composition may include about 0.5 wt % to about 1.0 wt % of carbon, about 1.5 wt % to about 2.5 wt % of manganese, about 0.3 wt % to about 1.0 wt % of silicon, about 1.5 wt % to about 2.5 wt % of nickel, about 0.0 wt % to about 0.5 wt % of molybdenum, about 1.5 wt % to about 2.0 wt % of aluminum, about 1.5 wt % to about 2.1 wt % of vanadium, about 1.8 wt % to about 2.8 wt % of titanium, about 0.0 wt % to about 4.0 wt % of niobium, about 4.0 wt % to about 5.0 wt % of boron, about 0.0 wt % to about 3.0 wt % of tungsten, and the balance being iron.

Still other, alternative embodiments are also contemplated for the composition. For example, the composition may include from about 0.05 wt %, about 0.10 wt %, or about 0.20 wt % to about 1.0 wt %, about 1.5 wt %, or about 2.0 wt % of carbon. In some embodiments, the composition may include from about 0.01 wt %, about 0.05 wt %, or about 0.10 wt % to about 3.0 wt %, about 3.5 wt %, or about 4.0 wt % of manganese. In some embodiments, the composition may include from about 0.01 wt %, about 0.10 wt %, or about 1.0 wt % to about 3.0 wt %, about 3.5 wt %, or about 4.0 wt % of nickel. In some embodiments, the composition may include from about 0.1 wt %, about 0.3 wt %, or about 0.5 wt % to about 2.5 wt %, about 3.0 wt %, or about 3.5 wt % of titanium. In some embodiments, the composition may include from about 0.01 wt %, about 0.05 wt %, about 0.10 wt %, or about 0.20 wt % to about 5.0 wt %, about 6.0 wt %, or about 7.0 wt % of niobium. In some embodiments, the composition may include from about 2.0 wt %, about 2.5 wt %, or about 3.0 wt % to about 5.0 wt %, about 6.0 wt %, or about 7.0 wt % of boron. In some embodiments, the composition may include from about 0.01 wt %, about 0.10 wt %, or about 1.0 wt % to about 8.0 wt %, about 10.0 wt %, or about 12.0 wt % of tungsten. In some embodiments, a balance of the composition may be iron.

In another example, the composition may include about 0.1 wt % to about 1.5 wt % of carbon, at most about 3.0 wt % of manganese, at most about 1.5 wt % of silicon, about 0.5 wt % to about 4.0 wt % of nickel, at most about 2.0 wt % of molybdenum, about 1.3 wt % to about 6.0 wt % of aluminum, about 0.6 wt % to about 3.0 wt % of vanadium, about 0.6 wt % to about 3.0 wt % of titanium, at most about 6.0 wt % of niobium, about 3.0 wt % to about 5.5 wt % of boron, at most about 10 wt % of tungsten, at most about 0.30 wt % of chromium, which may be included incidentally in the composition, e.g., without intentionally being added to the composition. A balance of the composition may be iron.

In an embodiment, the composition may include about 0.6 wt % to about 1.3 wt % of carbon, about 2.4 wt % to about 3.0 wt % of manganese, at most about 1.0 wt % of silicon, about 1.6 wt % to about 2.2 wt % of nickel, about 0.2 wt % to about 0.5 wt % of molybdenum, about 1.4 wt % to about 2.0 wt % of aluminum, about 1.7 wt % to about 2.4 wt % of vanadium, about 0.6 wt % to about 3.0 wt % of titanium, at most about 4.0 wt % of niobium, about 3.0 wt % to about 5.5 wt % of boron, at most about 3.0 wt % of tungsten, and a balance of iron.

In another embodiment, the composition may include about 0.75 wt % to about 1.25 wt % of carbon, about 2.4 wt % to about 3.0 wt % of manganese, at most about 1.0 wt % of silicon, about 1.6 wt % to about 2.2 wt % of nickel, at most about 0.5 wt % of molybdenum, about 1.4 wt % to about 2.0 wt % of aluminum, about 1.9 wt % to about 2.4 wt % of vanadium, about 2.0 wt % to about 2.5 wt % of titanium, at most about 4.0 wt % of niobium, about 4.0 wt % to about 4.8 wt % of boron, at most about 3.0 wt % of tungsten, and a balance of iron.

In some embodiments, the composition may be deposited using a twin-wire thermal sprayer, although other types of thermal sprayers may be employed without departing from the scope of the present disclosure. FIG. 1 illustrates a schematic view of such a twin-wire thermal sprayer 100, according to an embodiment. The sprayer 100 may include a nozzle 102, a first wire feeder 104, and a second wire feeder 106. The first wire feeder 104 may receive a first wire 108 and the second wire feeder 106 may receive a second wire 110. The wire feeders 104, 106 may include rollers, wheels, gears, drivers, etc., such that the wire feeders 104, 106 are operable to selectively draw in a length of the wires 108, 110, respectively, at a generally controlled rate. For example, the wires 108, 110 may be drawn in at substantially the same rate, but in other examples, may be drawn in at different rates, e.g., independently. The wires 108, 110 may be made from the same material, which may be or include one or more of the compositions discussed above.

Further, the sprayer 100 may also include a positive electrical contact 112 and a negative electrical contact 114. The positive electrical contact 112 may be electrically connected with the first wire 108 and the negative electrical contact 114 may be electrically connected with the second wire 110. Accordingly, the sprayer 100 may apply a DC voltage differential to the first and second wires 108, 110.

The first and second wires 108, 110 may be brought into close proximity to one another, e.g., nearly touching, at a discharge end 116 of the sprayer 100. Accordingly, an arc 117 between the oppositely charged wires 108, 110 may form, thereby melting the portions of the wires 108, 110 proximal to the discharge end 116.

The nozzle 102 may be coupled with a source of gas 119, which may be a compressed gas. Although schematically illustrated as being positioned within the sprayer 100, it will be appreciated that the source of gas 119 may be external to the sprayer 100 (e.g., a tank, compressor, or combination thereof). Furthermore, the gas may be compressed air. In other embodiments, other types of gas, such as one or more inert gases, nitrogen, etc. may be employed in addition to or instead of compressed air. The nozzle 102 may direct the gas toward the melted ends of the wires 108, 110, thereby atomizing and expelling the molten material of the wires 108, 110 into a stream of droplets 118.

The stream of droplets 118 may be sprayed toward a substrate 120, which may be a downhole component such as a downhole tool, an oilfield tubular, or a combination thereof. Examples of the downhole tools that may be employed as the substrate 120 (or a portion thereof) include, but are not limited to, centralizers, stabilizers, packers, cement baskets, hole openers, scrapers, control-line protectors, turbulators. Examples of oilfield tubulars for use as the substrate 120 (or a portion thereof) include, but are not limited to, drill pipe and casing, and/or any other generally cylindrical structure configured to be deployed into a wellbore.

When the droplets 118 collide with the substrate 120, some of the droplets 118 may solidify rapidly in place on the substrate 120, forming a layer of material 122. Other droplets 118 may flow off of the substrate 120, e.g., as an overspray 124. The overspray 124 may be collected and recycled, or may be discarded.

As mentioned above, the depositing process, such as using the sprayer 100, may form droplets 118 that deposit on the substrate 120 without creating a heat-affected zone, in at least one embodiment. Without being bound by theory, the droplets 118 may have insufficient heat capacity, for example, because of their relatively small size, to transfer enough heat to raise the temperature of the substrate 120 to a point where the metallurgical properties of the substrate 120 change.

The droplets 118 may be applied as the substrate 120 and/or the sprayer 100 move, relative to one another, e.g., so as to define a generally sweeping path. After being deposited in a first sweep, the droplets 118 may rapidly cool and solidify to begin the layer 122, and then a second sweep (and, e.g., many subsequent sweeps) may be conducted such that the layer 122 grows thicker with each sweep. The resultant layer 122 may be generally homogeneous or may include identifiable strata representing the successive sweeps.

In at least some embodiments, the rate at which the sprayer 100 sweeps and/or the rate at which the droplets 118 are deposited on the substrate 120 may be controlled. The rate at which the sprayer 100 sweeps may be controlled by adjusting the speed at which the sprayer 100 is moved, or the speed at which the substrate 120 is moved relative to the sprayer 100, or both. Further, the rate at which the material is melted and projected from the sprayer 100 may also be adjusted, e.g., by adjusting the feed rate of the wires 108, 110 and/or the pressure or flowrate of the gas through the nozzle 102.

In some embodiments, a maximum temperature for the substrate 120 may be determined based on the characteristics of the substrate 120. For example, the maximum temperature may be set to a value that is less than the tempering temperature of the substrate 120. The sweep rate and/or deposition rate may be adjusted such that the substrate 120 does not exceed this temperature. In a specific embodiment, the substrate 120 may have a tempering temperature of about 400° F. (204° C.). Thus, the deposition process may have a lower maximum temperature it may be allowed to impart on the substrate 120, e.g., about 375° F. (191° C.). Accordingly, the speed of the sweep may be controlled to ensure that the nominal temperature of the substrate 120 proximal to the deposition location (i.e., the location of the layer 122) does not reach or exceed the maximum temperature. In other examples, the tempering temperature may be lower. For example, the substrate 120 may be aluminum, and may have a tempering temperature of about 300° F. (149° C.). In turn, the maximum temperature for the substrate 120 during the deposition process may be set to 275° F. (135° C.), with the sweep rate being controlled accordingly. It will be appreciated that the foregoing temperatures are merely illustrative examples, and the actual maximum and tempering temperatures (and/or others) may vary widely according to the material from which the substrate 120 is made.

In some embodiments, the temperature of the substrate 120 may be further controlled, e.g., by using a cooling medium (e.g., a flow of gas), so as to further transfer heat from the substrate 120 during the deposition process.

In other embodiments, the substrate 120 may be configured for high-temperature use, and thus the composition of material may be employed in a welding operation, such as stick-and-wire welding, MIG and TIG welding, plasma arc, welding, etc.

Figure 2:
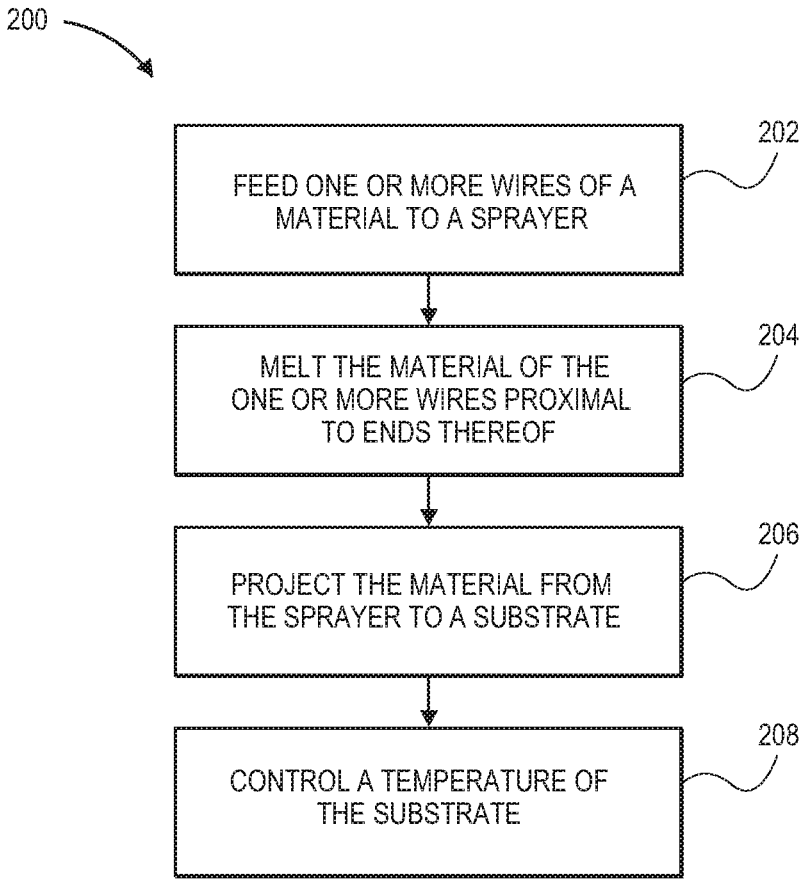
FIG. 2 illustrates a flowchart of a method for depositing a composition on a substrate, according to an embodiment.

FIG. 2 illustrates a flowchart of a method 200 for depositing a composition on a substrate, according to an embodiment. The method 200 may be best understood with reference to the foregoing description of the sprayer 100, which may be employed in the implementation of the method 200; however, it will be understood that the method 200 is not limited to any particular spraying apparatus or type of substrate, or any other structure, unless otherwise expressly stated herein.

The method 200 may begin by feeding one or more wires of a material to a sprayer, as at 202. The material may include one or more of the compositions discussed above. The method 200 may further include melting the material of the one or more wires, proximal to ends thereof, as at 204. For example, melting at 204 may be implemented by applying a voltage differential to two or more wires, and bringing the wires into proximity of one another at a discharge end of the sprayer. The voltage differential may cause an electrical arc to form between the wires, causing the wires to melt.

The method may also include projecting the material from the sprayer onto a substrate, as at 206. For example, the sprayer may receive a supply of compressed gas, such as air, through a nozzle directed at the molten ends of the wires. This flow of gas from the nozzle may atomize the molten material (e.g., produce relatively small droplets of the material), and propel the molten material through the discharge end of the sprayer. Thereafter, the molten material (e.g., atomized into droplets) may be deposited onto the substrate to form a layer of material.

In some embodiments, the method 200 may optionally include controlling (e.g., while projecting at 206) a temperature of the substrate, as at 208. For example, projecting the material at 206 may include sweeping the sprayer across an area of the substrate, e.g., multiple times, so as to build layer upon layer of the material. In this manner, for example, one or more projections of any dimension up to about 3.00 inches may be created. In various embodiments, the dimension may range from a low of about 0.010 inches, about 0.10 inches, or about 1.00 inches, to a high of about 2.50 inches, about 2.75 inches, or about 3.00 inches. In several specific embodiments, the dimension may be about 0.025 inches, about 0.050 inches, about 0.075 inches, about 0.10 inches, about 0.25 inches, about 0.50 inches, about 0.75 inches, about 1.00 inches, about 1.25 inches, about 1.50 inches, about 1.75 inches, about 2.00 inches, about 2.25 inches, about 2.50 inches, or about 2.75 inches.

Further, the sweep distance, time, rate, etc. may be controlled, as may be the deposition rate (e.g., wire feed rate, compressed gas feed rate, or both), so as to maintain the substrate at a temperature that is below a maximum temperature. In some embodiments, the temperature of the substrate may additionally or instead be controlled by providing a heat transfer (cooling) medium to the substrate, so as to remove heat therefrom. The maximum temperature may be predetermined, and may be lower than a tempering temperature, or another metallurgically significant temperature, of the substrate.

Figure 3:
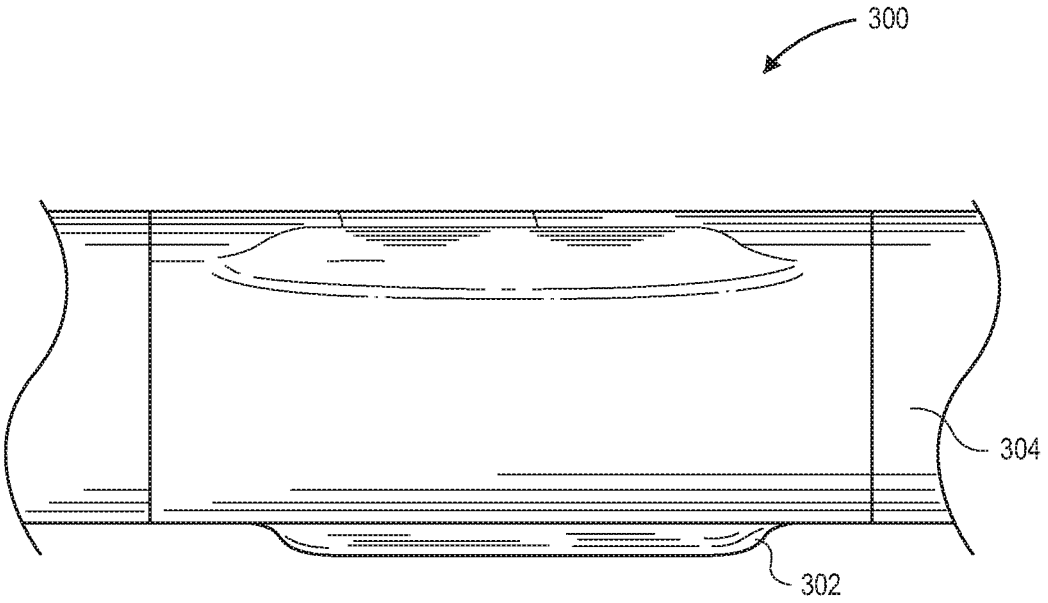
FIGS. 3-8 illustrates side perspective views of several centralizers, according to some embodiments.
Figure 4:
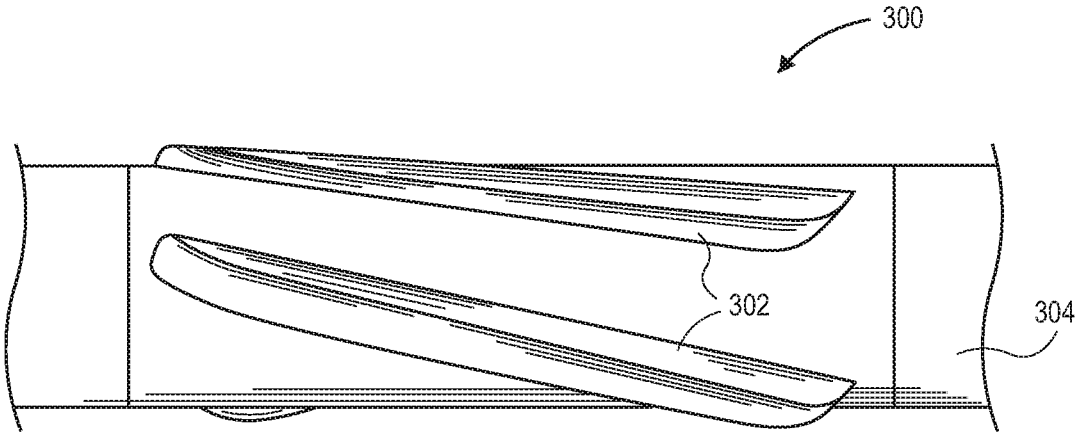

In some embodiments, the composition may be applied to a downhole component acting as the substrate. In one example, the downhole component may be an oilfield tubular (e.g., a casing or drill pipe). FIGS. 3 and 4 illustrate side perspective views of two embodiments of a centralizer 300, which may be at least partially formed in this way. It will be appreciated that the illustrated centralizer 300 is but one type of downhole tool that may be employed with the compositions and methods of the present disclosure, and is described herein for illustrative purposes only.

Continuing with the illustrative example, the centralizer 300 has blades 302, which are disposed on an oilfield tubular (hereinafter, "tubular") 304. The blades 302 may be constructed from an embodiment of the composition discussed above. The blades 302 may thus be formed from the layer 122 (FIG. 1), and may be coupled directly to and extend outwards from the tubular 304. In other embodiments, the blades 302 may be formed as structures separate from the tubular 304, and may be coated with an embodiment of the composition discussed above, such that the blades 302 of the centralizer (or another portion of another tool) may provide the substrate. In either example, i.e. where the layer 122 forms the blades 302 (or another structure), or is formed as a coating on the blades 302, the layer 122 may be considered to be extending outwards from the tubular 304.

In some embodiments, the blades 302 may extend radially outwards from the tubular 304 by a distance of between about 0.010 inches and about 3.0 inches, although other distances are contemplated and may be employed without departing from the scope of the present disclosure. Moreover, the distance need not be constant along the blades 302, and in some embodiments may vary.

The blades 302 may be configured to engage a surrounding tubular in a wellbore. For example, such surrounding tubulars may include a casing, liner, or the wellbore wall itself. The blades 302, which may or may not extend to the same radial height, may provide a generally annular gap between the tubular 304 and the surrounding tubular.

In FIG. 3, the blades 302 are shown extending generally straight in the axial direction, e.g., along the tubular 304. In FIG. 4, the blades 302 extend circumferentially as well as in the axial direction, e.g., in a partial helix. In other embodiments, the blades 302 may extend helically around the tubular 304 more than once (e.g., at least one time around plus any fraction of a second time). In still other embodiments, the blades 302 may include multiple curves, bends, etc. and may take any shape.

Figure 5:
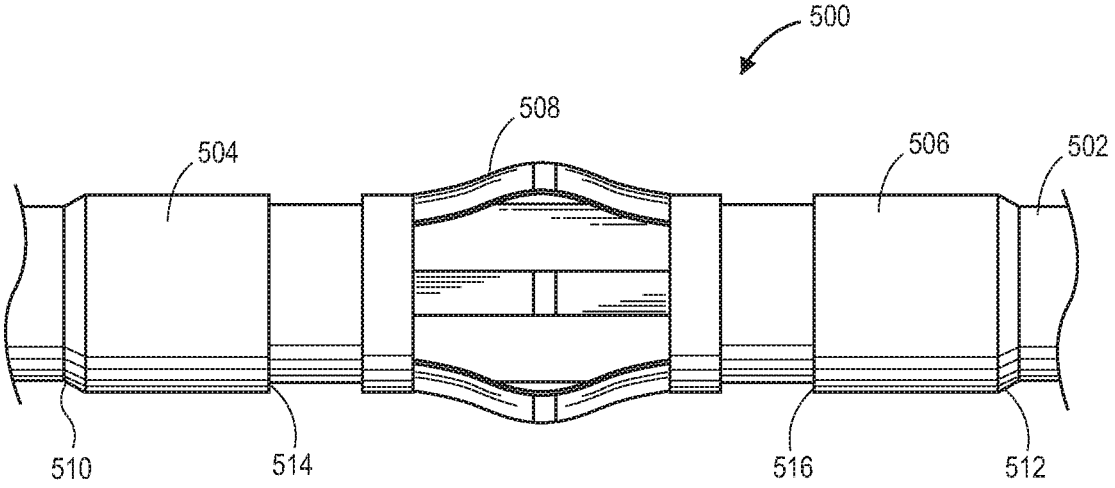
Figure 6:
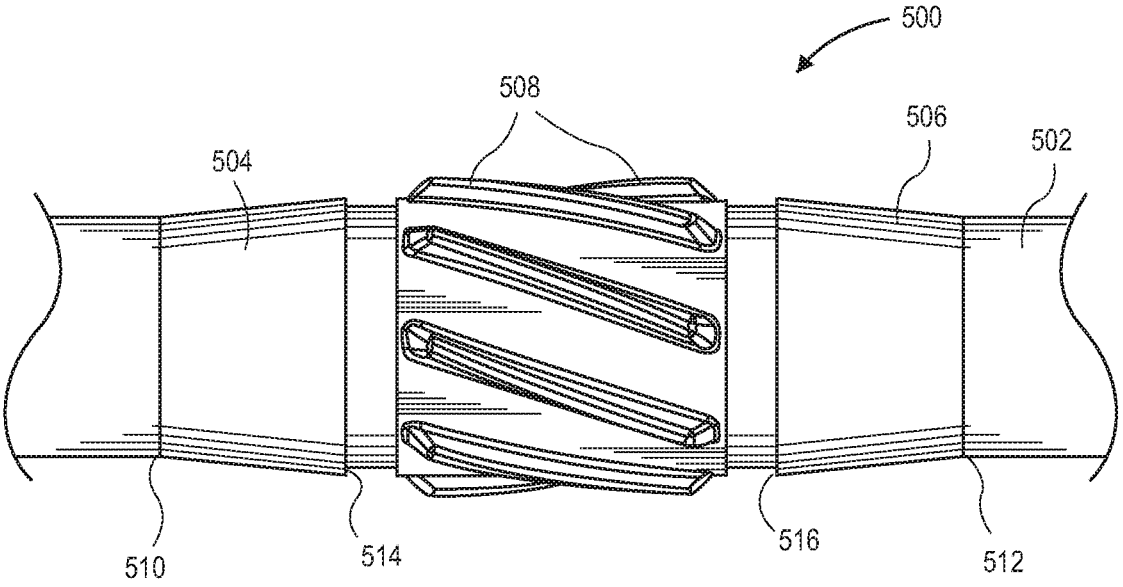

FIGS. 5 and 6 illustrate side perspective views of two embodiments of another centralizer 500, in accordance with the disclosure. An example of the centralizer 500 shown in FIG. 5 may be constructed according to one or more embodiments of the centralizer discussed in U.S. Patent Publication No. 2014/0096888, which is incorporated by reference herein in its entirety. In other embodiments, the centralizer 500 may have other constructions. The centralizer 500 may be received around an oilfield tubular 502, e.g., by sliding the centralizer 500 over an end of the tubular 502 or by opening (e.g., as with a hinge) the centralizer 500 and receiving the tubular 502 laterally into the centralizer 500. Further, the centralizer 500 may be positioned axially between or "intermediate" of two stop collars 504, 506, which may be formed from an embodiment of the composition discussed above, e.g., using an embodiment of the method 200. The centralizer 500 is illustrated by way of example and may be substituted with any other type of tool (e.g., a stabilizer, packer, cement basket, hole opener, scraper, control-line protector, turbulator, and/or the like).

Continuing with the illustrated example, in some embodiments, the centralizer 500 may include one or more blades 508, which may extend radially outward from the tubular 502, and may be configured to engage a surrounding tubular in a wellbore. The surrounding tubular may be a casing, liner, or the wellbore wall itself. The blades 508 may be formed in any suitable fashion, such as by welding, fastening, using one or more thermal spray compositions such as those discussed above, or otherwise attaching ribs to collars, may be integrally formed from a tubular segment, and/or the like. In some embodiments, the blades 508 may be coated with an embodiment of the thermal spray composition discussed above. The blades 508 may extend helically, partially helically, straight, or in any other geometry.

The centralizer 500 may be free to rotate with respect to the tubular 502. Further, the centralizer 500 may have a range of axial movement, e.g., between the two stop collars 504, 506, which may be disposed on either axial side of the centralizer 500, and spaced apart by a distance that is greater than an axial dimension of the centralizer 500. The stop collars 504, 506 may be fixed to the tubular 502, and may thus engage the centralizer 500, so as to limit the axial range of motion of the centralizer 500 with respect to the tubular 502 to the distance between the stop collars 504, 506.

Furthermore, the stop collars 504, 506 may be tapered, e.g., proceeding from a smaller, outboard outer diameter at sides 510, 512 facing away from the centralizer 500 to a larger, inboard outer diameter at sides 514, 516 facing toward the centralizer 500. Thus, the stop collars 504, 506 may present a more gradual positive outer diameter increase, as proceeding along either direction of the tubular 502, so as to reduce collisions with wellbore obstructions, cuttings, etc.

Figure 7:
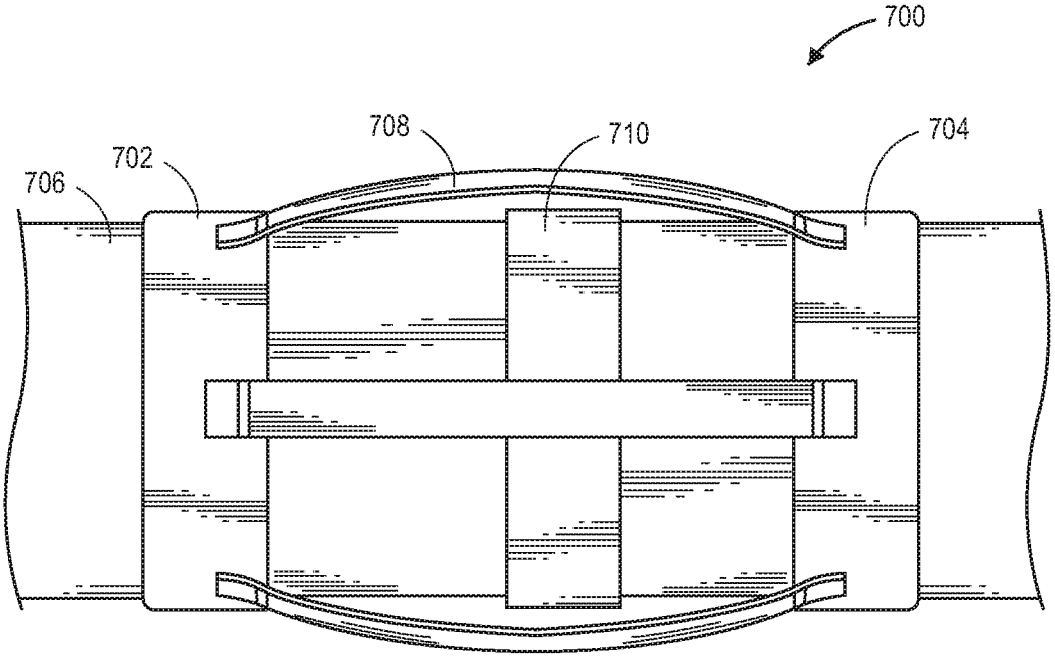

FIG. 7 illustrates a side perspective view of another centralizer 700, according to an embodiment. Again, the centralizer 700 is depicted for purposes of illustration, and may be readily substituted with other tools, depending, e.g., on the application. The centralizer 700 may have two end collars 702, 704, which may be received around an oilfield tubular 706. A plurality of ribs 708, which may be rigid, semi-rigid, or flexible bow-springs, may extend between the end collars 702, 704.

Furthermore, the centralizer 700 may straddle a stop collar 710, with the centralizer 700 having its end collars 702, 704 on either axial side of the stop collar 710, such that the end collars 702, 704 are prevented from sliding past the stop collar 710. The stop collar 710 may be formed from one or more embodiments of the composition discussed and disclosed above, e.g., using a thermal spray depositing process, as also discussed above. The stop collar 710 may thus serve to limit the axial range of motion to the distance between the end collars 702, 704. In addition, in some embodiments, the ribs 708 and/or the end collars 702, 704 may be coated with the thermal spray composition.

Figure 8:
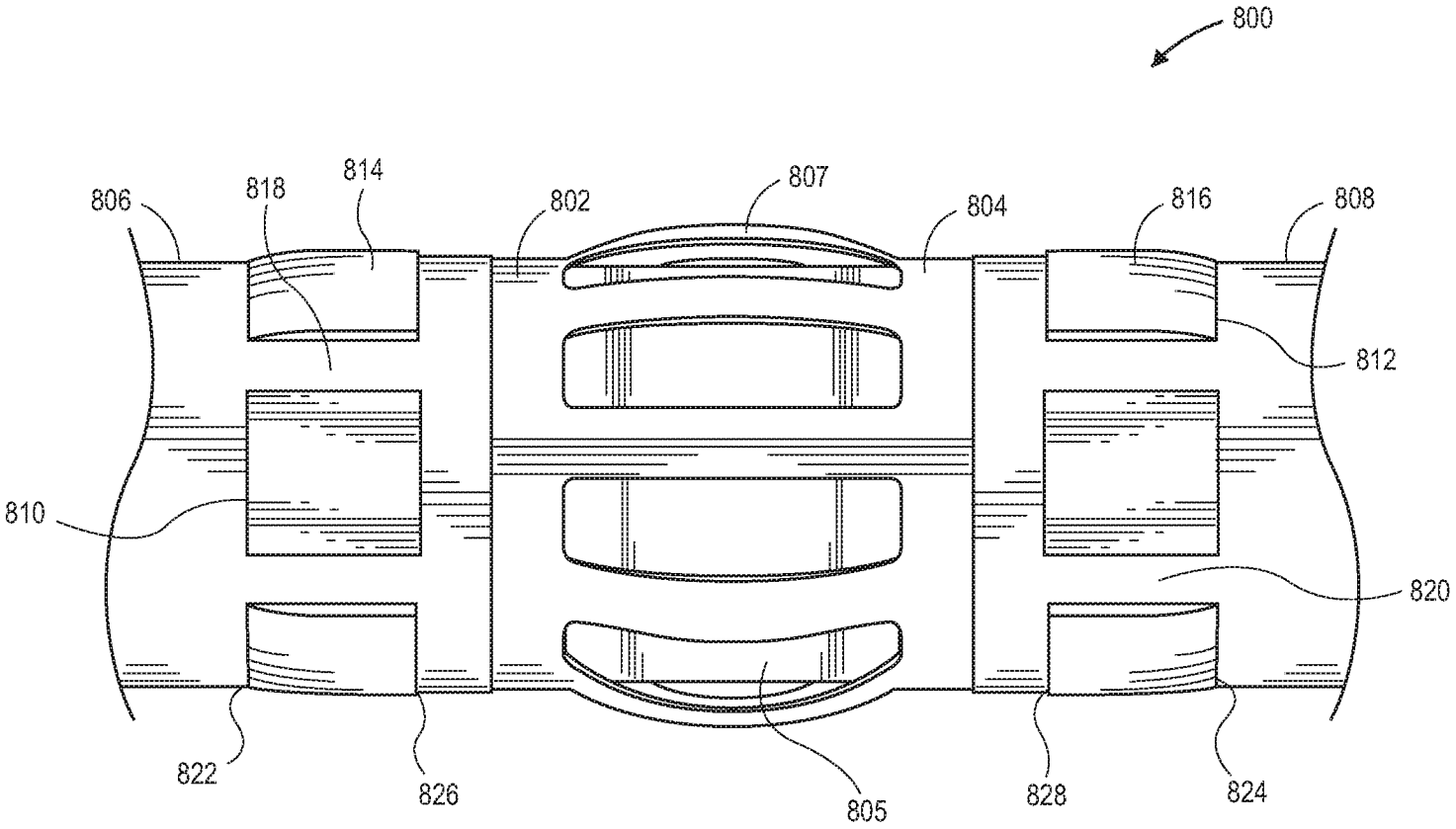

FIG. 8 illustrates a side perspective view of yet another centralizer 800, according to an embodiment. Here again, the centralizer 800 is depicted for purposes of discussion, and may be readily substituted with other tools, e.g., depending on the application. In this embodiment, the centralizer 800 may include two end collars 802, 804 (although embodiments with a single end collar are contemplated), which may be received around an oilfield tubular 805. The centralizer 800 may include protrusions 814, 816, which may be coupled directly to the tubular 805, e.g., by an embodiment of the method 200 and/or may include one or more embodiments of the composition described above.

The centralizer 800 may include ribs 807, which may be rigid, semi-rigid, or, as shown, flexible bow springs, which may extend axially between the end collars 802, 804. The centralizer 800 may also include one or more anchor segments (two are shown: 806, 808), which may be disposed on the tubular 805 so as to engage opposing axial ends of the end collars 802, 804. In some embodiments, however, the anchor segments 806, 808 may be omitted.

In embodiments in which the anchor segments 806, 808 are provided, the anchor segments 806, 808 may define windows 810, 812 through which the one or more protrusions 814, 816 extend. Bridges 818, 820 of the anchor segments 806, 808 may be defined circumferentially between adjacent windows 810, 812. Further, the protrusions 814, 816 may bear on anchor segments 806, 808 so as to restrict axial and/or rotational movement of the centralizer 800 relative to the tubular 805. The protrusions 814, 816 may be or include one or more embodiments of the composition described above, and may be formed using the thermal spray depositing process also described above.

In embodiments in which the anchor segments 806, 808 are omitted, the end collars 802, 804 may bear directly on the protrusions 814, 816, which may be segmented, as shown, or continuous. The protrusions 814, 816 may thus provide a function similar to that provided by the stop collars discussed above. Further, the protrusions 814, 816 may be tapered on at least one side thereof (e.g., an outboard side 822, 824), and generally square, proceeding generally straight in a radial direction, on another side thereof (e.g., an inboard side 826, 828). The tapered side 822, 824 may deflect or otherwise avoid engagement with other objects in the wellbore, while the square side 826, 828 may provide an engagement surface for engaging the anchor segments 806, 808 (or the end collars 802, 804).

In an embodiment, the windows 810, 812 or the protrusions 814, 816 may be sized to allow movement in a longitudinal and/or circumferential (rotational) direction. For instance, in an embodiment, the protrusions 814, 816 may be sized axially smaller than the windows 810, 812, circumferentially smaller than the windows 810, 812, or both axially and circumferentially smaller than the windows 810, 812 through which they extend. When the protrusions 814, 816 are axially smaller than the windows 810, 812, and, e.g., are generally aligned, the protrusions 814, 816 may allow for a range of axial motion of the centralizer 800 with respect to the tubular 802. The range may be, for example, the difference between the axial dimensions of the protrusions 814, 816 and the windows 810, 812. When the protrusions 814, 816 are smaller than the windows 810, 812 in the circumferential direction, the protrusions 814, 816 may allow for a range of rotational movement of the centralizer 800 with respect to the tubular 802. The range may be, for example, the difference between the circumferential dimensions of the protrusions 814, 816 and the windows 810, 812. Allowing axial and/or rotational movement of the centralizer 800 relative to the tubular 802 may help prevent damage to the centralizer 800 as the centralizer 800 passes through the wellbore (e.g., through a close-tolerance restriction and/or the like).

Figure 9:
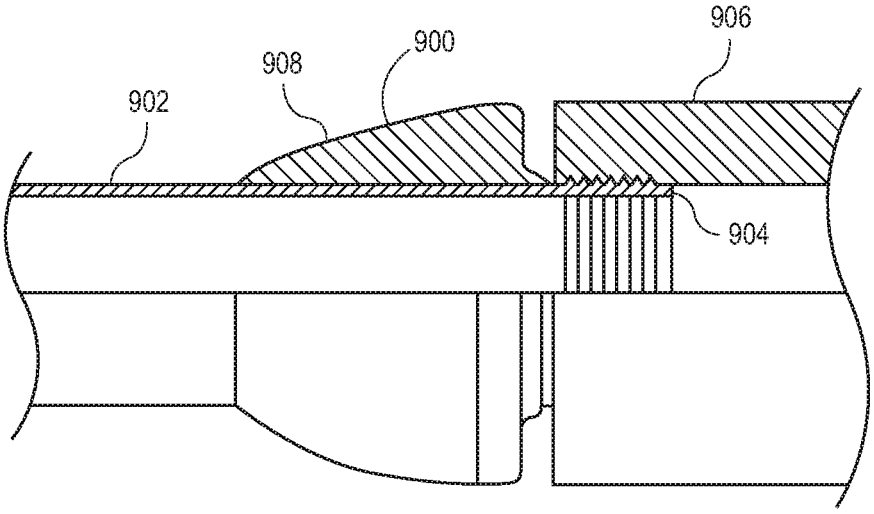
FIG. 9 illustrates a quarter-sectional view of a guide ring installed on a tubular, according to an embodiment.

FIG. 9 illustrates a side, quarter-sectional view of a guide ring 900 installed on a tubular 902, according to an embodiment. The guide ring 900 may be constructed at least partially from one or more embodiments of the composition discussed above. Further, the guide ring 900 may be formed using one or more embodiments of the method 200 discussed above.

In an embodiment, the tubular 902 may be a casing, and the guide ring 900 may be positioned adjacent to an end 904 of the tubular 902. The tubular 902 may be connected to a casing connection collar 906 at the end 904, e.g., via a threaded engagement, as shown. In other embodiment, such a threaded connection may be tapered. In still other embodiments, the connection between the tubular 902 and the casing connection collar 906 may be non-threaded. In embodiments where the end 904 is threaded, the guide ring 900 may be positioned away from the threaded region, so as to not interfere with the threaded engagement, while still being "adjacent" to the end 904.

In some embodiments, the end 904 of the tubular 902 may be received into the casing connection collar 906. Thus, the casing connection collar 906 may be radially larger than the tubular 902, i.e., may extend radially outward from the tubular 902. As such, the casing connection collar 906 may define an upset in a string of the tubulars 902, connected together end-to-end by such casing connection collars 906. The square shoulder of casing connection collar 906 may be prone to hanging-up on obstacles when being run into wellbore, e.g., in high-angle wells where a larger portion of the weight of a string of the tubulars 902 may rest on the low side of the wellbore. This hanging-up may damage to the casing connection collar 906 and/or may damage to the internal seats and seal areas of the well head, liner hangers and such.

The guide ring 900 may prevent or at least mitigate such damage. The guide ring 900, connected to the tubular 902, may thus define part of the outer surface of the tubular 902 as it extends outward from the tubular 902. An outer surface 908 of the guide ring 900 may, in turn, define a ramp shape. The outer surface 908 of the guide ring 900 may increase in diameter, as proceeding towards the end 904, from slightly larger than the outer diameter of the tubular 902 to substantially equal (e.g., within about 10%) the outer diameter of the casing connection collar 906. As such, the ramp shape may be inclined with respect to the tubular 902 at an angle of from a low of about 1°, about 5°, about 15°, about 25°, to a high of about 35°, about 45°, about 55°, or about 60°. Thus, the guide ring 900 may provide a more gradual transition from the smaller, outer diameter of the tubular 902 to the larger, outer diameter of the casing connection collar 906, e.g., across all or at least a portion of the axial dimension of the guide ring 900.

It will be appreciated that the description of the guide ring 900 in the context of a casing tubular 902 and the casing connection collar 906 is merely an example. In other embodiments, the guide ring 900 may be employed in any other application for providing a tapered transition from a smaller diameter structure to a larger diameter structure.

EXAMPLES

An understanding of the foregoing description may be furthered by reference to the following non-limiting examples.

Specimens were prepared within the composition ranges of the embodiments of the composition described above. These specimens were tested for abrasive wear rate, shock impact, cracking and spalling from cylindrically-induced stress, and hardness.

Three examples of the specimens are as follows:

TABLE 1

| Specimen Compositions | | | |
|---|---|---|---|
| Element | Specimen 1 | Specimen 2 | Specimen 3 |
| C | 0.83 | 0.77 | 0.62 |
| Mn | 2.52 | 2.40 | 2.39 |
| P | 0.016 | 0.015 | 0.015 |
| S | 0.020 | 0.022 | 0.020 |
| Si | 0.70 | 0.68 | 0.81 |
| Ni | 1.71 | 1.78 | 1.80 |
| Mo | <0.02 | <0.02 | <0.02 |
| Cr | 0.17 | 0.16 | 0.19 |
| Cu | 0.04 | 0.04 | 0.04 |
| Al | 0.72 | 2.00 | 2.33 |
| V | 1.80 | 1.72 | 1.95 |
| Ti | 2.22 | 2.02 | 2.53 |
| Nb | 0.04 | 0.08 | 0.08 |
| Co | <0.02 | <0.02 | <0.02 |
| B | 4.32 | 4.38 | 4.87 |

TABLE 1-continued

| Specimen Compositions | | | |
|---|---|---|---|
| Element | Specimen 1 | Specimen 2 | Specimen 3 |
| W | <0.02 | 0.64 | 0.49 |
| Zr | <0.02 | <0.02 | <0.02 |
| Sn | <0.02 | <0.02 | <0.02 |
| Fe | Balance | Balance | Balance |

The elements P, S, Mo, Cr, Cu, Nb, Co, Zr, W, and Sn may be considered present in trace amounts in the example specimens above. Thus, any one or more of these elements may be included, e.g., in the amounts listed above, in embodiments of the composition in which the balance is Fe and one or more of these elements are not listed. Furthermore, the amounts listed above are not to be considered limiting on the disclosure, except as otherwise indicated in the claims. That is, in various examples, one or more of these elements may be present in greater relative amounts than the minimal amounts listed, while still being considered to be trace elements.

An abrasive wear rate test was performed using these specimens, according to the ASTM G-65 Dry Sand Rubber Wheel Test specification. The term "wear rate" refers to the rate at which an element degrades during a physical operation. The wear rate may be a function of a material's weight loss due to abrasive forces, at least in this test. Several ASTM G-65 Dry Sand Rubber Wheel Tests were conducted, and the average wear rate was 0.30 grams of weight loss after 6,000 revolutions. In particular, the specimens performed as follows:

TABLE 2

| Specimen Wear Rate Tests Results | | | |
|---|---|---|---|
| | Specimen 1 | Specimen 2 | Specimen 3 |
| Wear Rate (g/6,000rev) | 0.387 | 0.303 | 0.406 |

A drop test was also performed, for determining shock-impact resistance. Specimen 3, as disclosed above, was prepared as a ½" (0.0127 m) thick band of material on a 4" (0.102 m) diameter section of pipe. The specimen was impacted by a free-falling 100 pound (45.36 kg) weight with a 2" (0.051 m) diameter round bar on the bottom. This test simulates two joints of pipe hitting each other during handling. The specimen withstood the impacts from an increasing drop height, at ambient temperatures and at 100° F. (37.8° C.), without cracking until a height of 60 inches was reached.

A cyclical pressure test was used to test for spalling and cracking. The test included applying a layer of the material to an oilfield casing having a length of 10 feet (3.05 m) and a diameter of 9⅝" (0.244 m). This test piece had end caps welded on and was subjected to increasing pressures, each of which was cycled five times, and then inspected for cracks. The purpose of the test was to compare the integrity of the material for cracking and spalling with increasing cyclical strain. The test was taken to burst and destruction of the casing. The material survived without noticeable spalling or cracking prior to the burst of the casing.

The hardness of the material was tested under procedures applicable for Rockwell Hardness, such as described in ASTM E18-08a, entitled "Standard Test Methods for Rockwell Hardness of Metallic Materials," among other sources. The Rockwell C Hardness ("HRc") was generally between 52 and 61 for the specimen.

TABLE 3

| Specimen Hardness | | | |
|---|---|---|---|
| | Specimen 1 | Specimen 2 | Specimen 3 |
| HRc | 54 | 60 | 61 |

Furthermore, the fumes exhibited during thermal spraying were noticeably low, and the efficiency of deposition (e.g., the amount of material that develops into a layer on the substrate as compared to the entire amount of material sprayed) was relatively high.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method for applying a composition to a substrate, comprising:

thermal spraying a layer of the composition onto the substrate, the substrate being provided by a tubular in an area adjacent to a radially-extending upset, such that the layer forms a guide ring that is at least partially ramp-shaped so as to provide a transition between the tubular and the upset, wherein the guide ring resulting from the thermal spraying has a thickness of from 0.75 inches to 3.00 inches and is configured to remain bonded to the downhole component when used downhole in a well; and controlling a surface temperature of the substrate while thermal spraying the layer of the composition by controlling at least one of sweep distance, sweep time, sweep rate, or deposition rate such that the surface temperature is maintained below a predetermined maximum temperature, wherein the composition is chromium-free.

2. The method of claim 1, wherein the composition comprises is iron.

3. The method of claim 2, wherein the composition comprises trace amounts of sulfur and phosphorous.

4. The method of claim 1, wherein thermal spraying the layer of the composition comprises:

feeding one or more wires into a sprayer, wherein the one or more wires provide the composition;

melting a portion of the one or more wires by applying an electrical current to the one or more wires, to melt the composition in the portion;

feeding a gas to the sprayer, such that the melted composition is projected through a nozzle of the sprayer; and depositing the melted, projected composition onto the substrate, such that the composition solidifies and forms into the layer.

5. The method of claim 4, wherein the predetermined maximum temperature is less than a tempering temperature of the substrate.

6. The method of claim 1, wherein thermal spraying the layer of the composition does not create a heat-affected zone in the substrate.

7. The method of claim 1, wherein the composition has a Rockwell Hardness C of between about 50 and about 65, and a wear rate of between about 0.20 grams per 6,000 rotations and between about 0.40 grams per 6,000 rotations in a Dry Sand Rubber Wheel Test.

8. The method of claim 1, wherein the composition comprises:

0.5 wt % to 1.0 wt % of carbon;
1.5 wt % to 2.5 wt % of manganese;
0.3 wt % to 1.0 wt % of silicon;
1.5 wt % to 2.5 wt % of nickel;
0.0 wt % to about 0.5 wt % of molybdenum;
1.5 wt % to 2.0 wt % of aluminum;
1.5 wt % to 2.1 wt % of vanadium;
1.8 wt % to 2.8 wt % of titanium;
0.0 wt % to 4.0 wt % of niobium;
4.0 wt % to 5.0 wt % of boron;
0.0 wt % to 3.0 wt % of tungsten; and
a balance of iron.

9. The method of claim 1, wherein controlling the surface temperature comprises using a cooling medium to transfer heat from the substrate.

10. The method of claim 9, wherein the cooling medium comprises a gas.

11. The method of claim 1, wherein controlling the surface temperature comprises controlling a feed rate of one or more wires including the composition to a thermal sprayer.

12. The method of claim 1, wherein the thickness is from 1.00 inches to 3.00 inches.

13. The method of claim 1, wherein controlling the surface temperature comprises controlling the sweep distance, the sweep time, the sweep rate, or a combination thereof.

14. The method of claim 1, wherein the area adjacent to the radially-extending upset is also adjacent to a threaded portion of the tubular, and wherein the upset comprises a collar that includes threads that receive the threaded portion of the tubular.

15. A method for applying a composition to a substrate, comprising:

thermal spraying a layer of the composition onto the substrate, the substrate being provided by a downhole component, wherein the layer resulting from the thermal spraying has a thickness of at least 0.10 inches and is configured to remain bonded to the downhole component when used downhole in a well; and controlling a surface temperature of the substrate while thermal spraying the layer of the composition by controlling at least one of sweep distance, sweep time, sweep rate, or deposition rate such that the surface temperature is maintained below a predetermined maximum temperature, wherein the composition is chromium-free, and wherein the composition comprises:

0.25 wt % to 1.25 wt % of carbon;
1.0 wt % to 3.5 wt % of manganese;
0.1 wt % to 1.4 wt % of silicon;
1.0 wt % to 3.0 wt % of nickel;
0.0 to 2.0 wt % of molybdenum;
0.7 wt % to 2.5 wt % of aluminum;

1.0 wt % to 2.7 wt % of vanadium;
1.5 wt % to 3.0 wt % of titanium;
0.0 wt % to 6.0 wt % of niobium;
3.5 wt % to 5.5 wt % of boron;
0.0 wt % to 10.0 wt % tungsten; and
a balance of iron.

16. The method of claim 15, wherein the balance comprises trace amounts of sulfur and phosphorous.

17. A method for applying a composition to a substrate, comprising:

feeding a first wire and a second wire to a nozzle, wherein the first and second wires each comprise the composition;

generating a voltage differential between the first and second wires, such that portions of the first and second wires melt;

spraying droplets comprising a combination of the portions of the first and second wires onto the substrate in a plurality of passes across the substrate, wherein droplets of a second pass build upon droplets of a first pass, so as to form a layer of the composition on the substrate, the substrate being provided by a tubular in an area adjacent to a radially-extending upset, such that the layer forms a guide ring that is at least partially ramp-shaped so as to provide a transition between an outer diameter surface of the tubular and an outer diameter surface of the upset, wherein the guide ring resulting from the thermal spraying has a thickness of at least 0.10 inches and is configured to remain bonded to the tubular when used downhole in a well, and wherein the composition is chromium-free.

18. The method of claim 17, further comprising controlling a temperature of the substrate during the thermal spraying, such that the substrate does not exceed a temperature of 400° F.

19. The method of claim 17, wherein controlling comprises comprising adjusting a sweep rate and/or deposition rate.

20. The method of claim 17, wherein controlling comprises applying a cooling medium to the substrate.

21. The method of claim 17, wherein the thickness is between 0.75 inches and 3.00 inches.

* * * * *